United States Patent [19]

Durante et al.

[11] 4,430,199

[45] Feb. 7, 1984

[54] PASSIVATION OF CONTAMINANT METALS ON CRACKING CATALYSTS BY PHOSPHORUS ADDITION

[75] Inventors: Vincent A. Durante, East Brunswick, N.J.; Dennis J. Olszanski, Erie, Pa.; William J. Reagan, Englishtown; Stanley M. Brown, Scotch Plains, both of N.J.

[73] Assignee: Engelhard Corporation, Edison, N.J.

[21] Appl. No.: 265,516

[22] Filed: May 20, 1981

[51] Int. Cl.[3] ..... C10G 11/05; B01J 37/28

[52] U.S. Cl. ..... 208/114; 208/52 CT; 502/20

[58] Field of Search ..... 208/114; 252/411 R

[56] References Cited

U.S. PATENT DOCUMENTS

| | | | |
|---|---|---|---|
| 2,758,097 | 8/1956 | Doherty et al. | 252/413 |
| 2,921,018 | 1/1960 | Helmers et al. | 208/114 |
| 2,977,322 | 3/1961 | Varvel | 252/411 R |
| 3,162,595 | 12/1964 | Szepe | 208/87 |
| 3,162,596 | 12/1964 | Andrerson et al. | 208/89 |
| 3,165,462 | 1/1965 | Friedman et al. | 208/86 |
| 3,711,422 | 1/1973 | Johnson et al. | 252/414 |
| 3,867,279 | 2/1975 | Young | 208/114 |
| 3,977,963 | 8/1976 | Readal et al. | 208/120 |
| 4,025,458 | 5/1977 | McKay | 208/113 |
| 4,031,002 | 6/1977 | McKay | 208/113 |
| 4,040,945 | 8/1977 | McKinney et al. | 208/113 |
| 4,083,807 | 4/1978 | McKinney et al. | 252/455 Z |
| 4,158,621 | 6/1979 | Swift et al. | 208/114 |
| 4,167,471 | 9/1979 | Bertus et al. | 208/74 |
| 4,179,358 | 12/1979 | Swift et al. | 208/114 |
| 4,182,923 | 1/1980 | Chu | 585/475 |
| 4,192,770 | 3/1980 | Singleton | 252/414 |
| 4,207,204 | 6/1980 | McKay et al. | 252/411 R |
| 4,216,120 | 8/1980 | Nielsen et al. | 252/430 |
| 4,222,896 | 9/1980 | Swift et al. | 252/437 |
| 4,228,036 | 10/1980 | Swift et al. | 252/437 |
| 4,238,367 | 12/1980 | Bertus et al. | 252/455 Z |
| 4,255,287 | 3/1981 | Bertus et al. | 252/455 Z |
| 4,256,564 | 3/1981 | Roberts et al. | 208/120 |
| 4,268,188 | 5/1981 | Bertus et al. | 208/128 |
| 4,272,400 | 6/1981 | Silbernagel et al. | 208/216 R |
| 4,295,955 | 10/1981 | Tu | 208/120 |
| 4,318,799 | 3/1982 | Yoo | 208/114 |
| 4,319,983 | 3/1982 | Yoo | 208/114 |
| 4,321,128 | 3/1982 | Yoo | 208/114 |

FOREIGN PATENT DOCUMENTS

| | | | |
|---|---|---|---|
| 556072 | 4/1958 | Canada | 208/114 |
| 446621 | 5/1936 | United Kingdom | 208/114 |
| 978576 | 12/1964 | United Kingdom | 208/114 |

*Primary Examiner*—Delbert E. Gantz
*Assistant Examiner*—O. Chaudhuri
*Attorney, Agent, or Firm*—Inez L. Moselle

[57] ABSTRACT

High gas and coke make due to contamination of a zeolitic fluid cracking catalyst by metal species such as nickel and vanadium during a cracking process is reduced by adding a phosphorus compound to the process. When the catalyst already contains a metals passivating agent or such agents are used in the cracking process further significant reduction in gas and coke make is realized without significant increase in regenerator temperature by adding additional phosphorus.

16 Claims, 1 Drawing Figure

FRESH METALS TOLERANCE TEST
FOR EXAMPLE 5
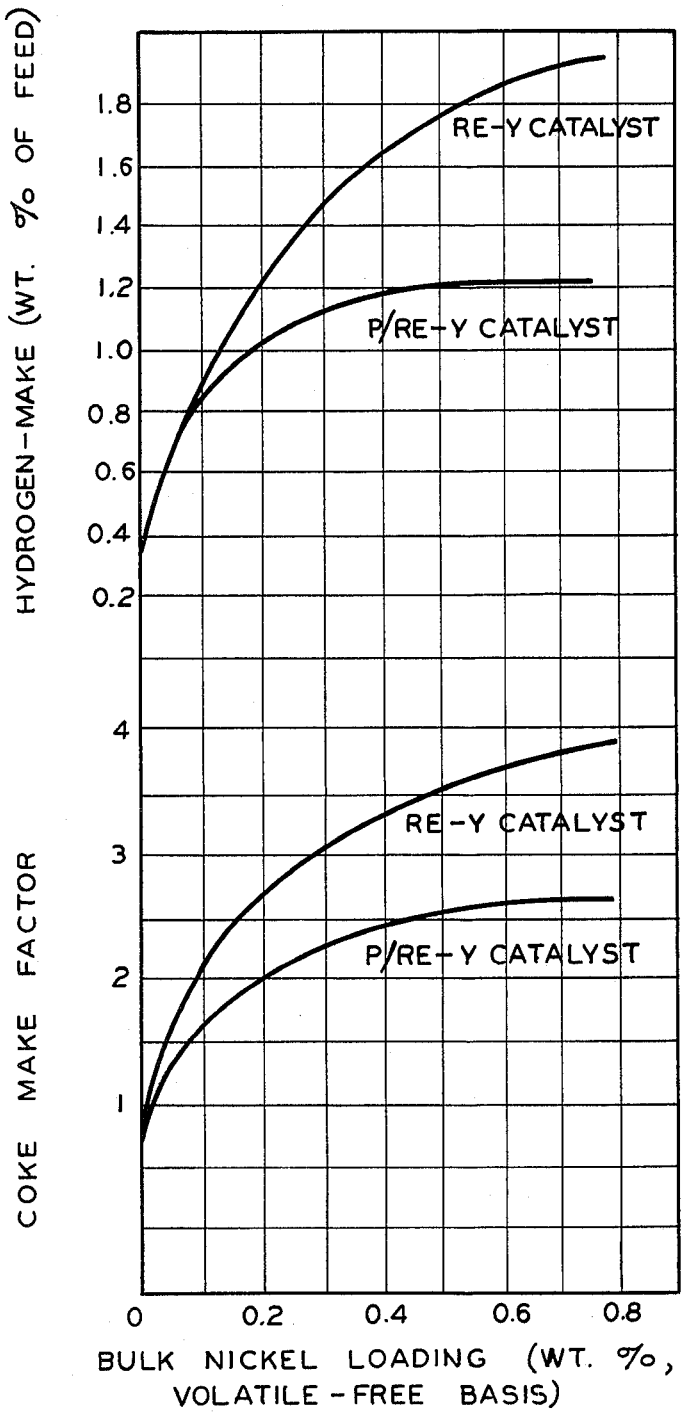

PASSIVATION OF CONTAMINANT METALS ON CRACKING CATALYSTS BY PHOSPHORUS ADDITION

BACKGROUND OF THE INVENTION

1. Field of the Invention

This invention relates to passivation of contaminant metals on cracking catalysts. More specifically this invention relates to an improved method for passivation of contaminent metals on zeolite cracking catalysts.

2. Prior Art

In a fluid catalytic cracking process, hydrocarbon feed material is cracked at elevated temperature in a reactor containing a fluidized catalyst therein. Several such cracking catalysts are available and comprise acid-activated clay and zeolitic catalysts, although the predominant type is the zeolitic catalyst. Catalytic cracking may also be carried out in a so-called "moving bed" unit wherein catalyst pellets move downward through rising, hot gaseous hydrocarbons. As the cracking process continues the activity of the catalyst gradually deteriorates. Fluid catalysts are typically removed, regenerated in a regenerator to burn off coke and provide heat for subsequent cracking reactions and returned to the reactor. In the regeneration step carbonaceous materials deposited on the catalyst during cracking are burned off with air. Typically the process may be run continuously with catalyst being drawn off continuously from the reactor, regenerated and returned to the reactor along with fresh catalyst added to make up for stack losses or to boost equilibrium activity.

The catalyst cannot be regenerated to the original activity level indefinitely, even under the best of circumstances, i.e. when accretions of coke are the only cause for reduced activity. When activity has deteriorated sufficiently zeolitic catalysts must be discarded.

Loss of activity or selectivity of the catalyst may also occur if certain metal contaminants arising principally from the hydrocarbon feedstock, such as nickel, vanadium, iron, copper and other heavy metals, deposit onto the catalyst. These metal contaminants are not removed by standard regeneration (burning) and contribute markedly to undesirably high levels of hydrogen, dry gas and coke and reduce significantly the amount of gasoline that can be made. Contaminant levels are particularly high in certain feedstocks, especially the more abundant heavier crudes. As oil supplies dwindle, successful economic refining of these heavier crudes becomes more urgent. In addition to reduced amounts of gasoline, these contaminant metals contribute to much shorter life cycles for the catalyst and an unbearably high load on the vapor recovery system. The increased expense of refining metals contaminated feedstocks due to these three factors lays a heavy economic burden on the refiner. Thus it would be desirable to find a way to eliminate metals contamination of the feedstock or to modify the catalyst in such a way as to passivate the aforementioned undesirable effects of the metal contaminants.

One method disclosed in U.S. Pat. Nos. 3,162,595; 3,162,596 and 3,165,462 is to remove the metals from the catalyst after the catalyst exits the reactor for regeneration. This is accomplished by a so-called demetallization process involving such steps as acid-washing, chlorinating, etc. to convert the metals on the catalyst to dispersable or volatile forms and separating the dissolved or dispersed metal poisons from the catalyst. This technology has not been widely used, presumably because of the expense involved.

Another method is to passivate the metal contaminants, or more specifically to ameliorate the undesirable effects thereof, by adding a passivating agent to the fresh catalyst, to the feedstock directly to impregnate the catalyst, or to regenerated catalyst, or to used cracking catalyst fines which are then added to the process. These passivating agents are metal compounds exemplified by an antimony tris (0,0-dihydrocarbylphosphorodithioate) disclosed in the following U.S. patents to McKay et al: Nos. 4,207,204; 4,031,002 and 4,025,458. The use of antimony compounds on catalyst fines is disclosed in U.S. Pat. No. 4,216,120 to Nielsen et al, and antimony compounds useful in restoring activity of used cracking catalyst is disclosed in U.S. Pat. No. 3,711,422 to Johnson.

Other passivating agents have also found utility for cracking catalysts. Bismuth and manganese compounds are disclosed by Readal et al in U.S. Pat. No. 3,977,963, and by McKinney et al in U.S. Pat. No. 4,083,807; and exclusive use of low levels of boron compounds are disclosed in U.S. Pat. No. 4,192,770 to Singleton. Tin compounds are disclosed in U.S. Pat. No. 4,040,945 to McKinney, and tin in combination with antimony is disclosed in U.S. Pat. No. 4,255,287 to Bertus et al. A thallium supplying material is disclosed in U.S. Pat. No. 4,238,367 to Bertus et al for passivation of contaminant metals.

Treating non-zeolitic cracking catalysts with phosphorus compounds is also known. For example U.S. Pat. No. 2,758,097 to Doherty et al discloses addition of $P_2O_5$ or compounds convertible to $P_2O_5$ to reduce the undesirable effects of nickel on nickel-poisoned siliceous cracking catalysts. U.S. Pat. No. 2,977,322 to Varvel et al discloses a method for deactivating metal poisons by contacting a clay catalyst with phosphorus in combination with chlorine compounds. U.S. Pat. No. 2,921,018 to Helmers et al discloses treating acid-activated clay with compounds of phosphorus to convert metallic poisons to their corresponding phosphorus compounds, thereby deactivating the contaminant metals. These patents do not recognize that adding certain phosphorus compounds, particularly phosphoric acids, can destroy the zeolite in zeolitic cracking catalysts after heat treatment.

Other methods of incorporating phosphorus into or onto cracking catalyst have been tried. U.S. Pat. Nos. 4,158,621 and 4,228,036 both to Swift et al disclose a silica-alumina-aluminum phosphate matrix incorporating a zeolite having cracking activity. In U.S. Pat. Nos. 4,179,358 and 4,222,896 both to Swift et al a magnesia-alumina-aluminum phosphate matrix composited with a zeolite having cracking activity is disclosed.

In U.S. Pat. No. 3,867,279 to Young a zeolite cracking catalyst containing 1–30% $P_2O_5$ for improved crush strength is disclosed. No utility of phosphorus for metals passivation is recognized in this patent.

It is an object of this invention to provide a method for controlling the detrimental effects of metallic contaminants, especially vanadium, on cracking catalysts, particularly zeolitic cracking catalysts.

Another object of the present invention is to provide a means by which phosphorus compounds may be incorporated into zeolitic cracking catalysts with minimized zeolite destruction.

Still another object of the present invention is to provide additional operational flexibility to catalytic cracking units limited by regenerator capacity by substitution of a portion of other known passivators by the phosphorus compounds of this invention.

SUMMARY OF THE INVENTION

We have discovered a way of improving the tolerance of zeolitic cracking catalysts towards metal poisons exemplified by Ni, V, Fe and Cu in the hydrocarbon feedstock by incorporating into the cracking process a phosphorus compound. The phosphorus compound may be incorporated by itself or in combination with one or more known passivating agents. The phosphorus compound may be added directly to the hydrocarbon feedstock, if soluble therein, or added on an inert diluent carrier material which can be blended with the catalyst, or added to the catalyst subsequent to or during its manufacture.

The phosphorus compound may also be added to contaminated regenerated catalyst to passivate the undesirable coke and gas-make activity of the metal poisons and restore the desirable selectivity (fraction of gasoline produced) of the catalyst.

When passivating agents such as antimony, tin, boron, thallium or compounds thereof are used to passivate contaminant metals, an additional improvement in passivation may be achieved by adding phosphorus compounds therewith. Alternatively the phosphorus compounds can be used to reduce the amount of antimony, tin and the like required for a given level of metals tolerance. This could be particularly important and desirable when a preponderance of vanadium exists in the hydrocarbon feedstock. Also when heat resulting from CO oxidation catalyzed by other known passivators is problematic, partial substitution with phosphorus will reduce CO burn since phosphorus as it exists on the catalyst has the advantage of not being an oxidation promoter.

BRIEF DESCRIPTION OF THE DRAWINGS

The sole FIGURE of the drawing has reference to Example 5 set forth hereinafter and shows how addition of phosphorus to a rare-earth exchanged fluid catalytic cracking catalyst containing zeolite Y lowers the hydrogen make and coke factor as a function of nickel loading on the catalyst.

DESCRIPTION OF THE PREFERRED EMBODIMENTS

The cracking catalysts used in practice of the present invention may contain zeolite or other cracking components but preferably contain synthetic Y faujasite type zeolite having effective pore sizes between 6 and 15 A in diameter. In many cases the zeolite may be ion-exchanged with rare earth species or other species to gain certain advantages in the catalytic cracking process. The ion-exchange may be carried out by well-known techniques in the art, for example immersion of the catalyst bodies in aqueous solution containing the exchangeable rare earth or other cations. The catalyst bodies comprise active zeolite and a matrix as disclosed for example in Swift et al (U.S. Pat. No. 4,179,358).

The phosphorus compound may be placed on the catalyst body or inert diluent carrier material by solution impregnation. For example an aqueous phosphorus salt such as ammonium hydrogen phosphate compounds may be used, for example, as disclosed in U.S. Pat. No. 4,182,923 to Chu. Alternatively, a non-aqueous solution of an organophosphorus compound such as tricresyl phosphate may be employed. After immersing the catalyst body or carrier material in the solution at a temperature and for a time sufficient for the phosphorus compound to become attached to the catalyst body or carrier material, the bodies so treated may be dried and calcined to form oxides of phosphorus on the bodies. Calcination temperatures may be typically in the range of about 800° F. to 1300° F. A suitable inert carrier material is calcined kaolin clay in the form of microspherical bodies of about the same size as the catalyst, viz. 20–150 microns in diameter. Alternatively, the phosphorus compound can be added to the slurry before spray drying to form the microspheres.

Phosphorus compounds may be added in amounts sufficient to result in levels of phosphorus on the catalyst or carrier material sufficient for the particular feedstocks. This may vary from 0.01% to about 5% by weight as P. Especially preferred is a level in the range 0.1% to 3% P by weight.

Certain economic and process control advantages may be realized by adding the phosphorus compound directly to the feedstock. This is especially true when levels of metal poisons in the feedstock vary widely. Other embodiments are equally possible. For example, the phosphorus compound may be added to regenerated catalyst to passivate the metal poisons already on the catalyst or to the regenerator itself in the form of a volatile compound of phosphorus.

It is especially preferred, however, to add the phosphorus compound to the zeolitic catalyst for ease of use.

The present invention has particular advantages when used in conjunction with known passivating agents such as an antimony tris (0,0-dihydrocarbylphosphorodithioate), a neutral hydrocarbon oil solution of which is commercially available under the trade name Vanlube 622. The additional phosphorus results in improved passivation, particularly for vanadium. The additional phosphorus may also be used to reduce the amount of antimony compound used.

The invention may be more fully understood from the following examples which are not to be construed as limiting.

EXAMPLE 1

In this example and in Examples 2 and 3, several alternative methods for preparing samples suitable for testing are illustrated.

A 300 g. sample of a zeolitic fluid cracking catalyst containing about 20–25% zeolite and about 2% total rare earth oxides on a volatile-free weight basis was partially deactivated by steam at 1475° F. to simulate commercial equilibrium catalyst which could be more easily evaluated in subsequent laboratory tests. The steam treatment involved passing 100% steam up through a fluidized bed of catalyst held at a specified temperature between 1450° F. and 1500° F. for a period of 4 hours. This treatment reduced the surface area (as measured by standard B.E.T. methods using nitrogen) from about 300 $m.^2/g.$ to about 180–190 $m.^2/g.$ This steam-treated catalyst was then impregnated with a solution of 96.4 g. of vanadyl naphthenate in 460 ml. of cyclohexane and dried at 200° F. to place the vanadium poison on the catalyst. This sample was subsequently impregnated with 62.7 g. of tricresylphosphate in 150 ml. of cyclohexane followed by oven drying at 200° F. overnight. Chemical analysis indicated that the sample contained 0.4% V and 1.69% P on a volatile-free basis. The volatile-free basis is the weight of the catalyst after heating to about 1800° F. for 1 hour in air. The surface area was reduced slightly to about 140 $m.^2/g.$ by this impregnation. The sample could then be evaluated for its cracking performance.

Other samples were prepared by varying the amounts of vanadium or nickel compounds and the amount of phosphorus passivator.

As an alternative, either fresh or steam-deactivated catalyst could be treated with the phosphorus passivator as in the above-described procedure and the treated catalyst contacted with nickel and/or vanadium-contaminated oil as the oil enters a laboratory-scale cracking unit. This procedure is more akin to actual commercial practice, but does not allow evaluation of catalytic activity at specified and fixed levels of metal contaminant, since the metal contaminant builds up on the catalyst as the cracking reactions proceed.

Because the exact chemical nature of the phosphorus on the catalyst can only be ascertained with great difficulty, it is preferred herein to report phosphorus levels as % P. Alternatively, a mole ratio of phosphorus-to-contaminant metal may be used.

EXAMPLE 2

In this example preparation of phosphorus-containing catalyst by an aqueous solution of inorganic phosphate salt is set forth.

A commercial grade of the same catalyst used in Example 1, viz. a rare earth exchanged faujasite zeolite cracking catalyst, was steam-treated at 1475° F. to partially deactivate the catalyst. This material was impregnated to incipient wetness with a saturated aqueous solution of ammonium dihydrogenphosphate, oven dried at 200° F., re-impregnated as above, and calcined in air at 1000°–1100° F. for 2 hours accompanied by the loss of volatile compounds such as ammonia and water. A chemical analysis showed the catalyst contained 1.0% P on a volatile-free basis. Various levels of phosphorus may be impregnated onto the catalyst by re-executing the impregnation/drying procedure.

An alternative procedure is to impregnate the phosphorus-containing compound onto fresh cracking catalyst followed by oven-drying, optional calcination, and steam treatment to simulate an equilibrium cracking catalyst. The resulting materials from the above two methods could then be contaminated with various levels of nickel, vanadium or compounds thereof, heat treated and evaluated for catalytic activity and selectivity by test methods well known in the art.

EXAMPLE 3

This example illustrates the desirability of using an inorganic salt of phosphoric acid rather than phosphoric acid itself or impregnating agent to introduce phosphorus onto a rare earth exchanged, zeolitic fluid cracking catalyst (REY catalyst).

Weighed quantities of rare-earth exchanged zeolitic cracking catalysts were impregnated to incipient wetness with aqueous solutions of the impregnating agents listed below. The concentration of the phosphorus compound in each impregnating solution was sufficient to achieve about 0.66% P on a volatile-free weight basis. The treated samples were dried in air at 290° F. for 1 hour followed by treatment in a muffle furnace at 500° F. for one hour followed by calcination in air at 1100° F. for one hour. Air cooled and humidity equilibrated samples could then be analyzed for approximate relative zeolite content by well known methods of powder X-ray diffraction, the results of which are shown below:

| Impregnating Agent | Relative Weight Fraction of Zeolite Remaining After Treatment |
|---|---|
| $H_3PO_4$ (aq.) | 0.6 |
| $(NH_4)_2HPO_4$ (aq.) | 1.0 |

A 40% greater zeolite loss resulted when phosphoric acid was used.

EXAMPLE 4

This example illustrates the relative CO oxidation abilities of phosphorus-treated cracking catalyst and catalyst treated with the known passivators antimony, bismuth, and tin.

A commercial non-rare earth exchanged cracking catalyst was partially steam deactivated. Separate portions of the steam treated catalyst were impregnated with aqueous solutions of known passivator compounds to introduce approximately 0.014 moles of passivator per 100 g. of catalyst followed by calcination in air at 1100° F. for 4 hours. Samples were introduced into a unit consisting of a fluidized bed reactor heated to 1200° F. and held at conditions simulating those found in commercial FCC unit regenerator vessels. A gas stream consisting of 1910 ppm $SO_2$, 5.07% CO, 5.5% $CO_2$, 2.91% $O_2$ and the balance $N_2$ was passed through 14 g. of each sample in the reactor for 12 minutes at approximately 200 ml. of gas per minute measured at room temperature on the exit side of the reactor. The gas exit stream was analyzed for CO and $CO_2$ concentrations by calibrated infrared detectors. Control runs of calcined steamed catalyst containing no passivator were also run. The relative ranking of CO oxidation ability of each sample compared to the control was determined to be Sn>>Bi>>Sb>P. Thus, the phorphorus treated catalyst was found to be the least likely to promote CO oxidation in a commercial FCC catalyst regenerator vessel.

EXAMPLE 5

In this example a "fresh" metals tolerance test was carried out in a laboratory-scale fluidized bed cracking unit employed on a single pass basis to place various levels of nickel and vanadium poisons onto catalyst samples with and without phosphorus impregnation. Catalyst samples were prepared according to Examples 1–3. Oil with varying levels of nickel contaminant, including about 0% nickel as a control, was used with different aliquots of given steam-deactivated catalyst. The conditions in the simulated cracking unit used to add nickel to the catalyst were: temperature =950° F., total catalyst/total oil=0.56 on a weight basis, WHSV (weight hourly space velocity)=12.0 $hour^{-1}$. A mid-continent full range gas oil of API gravity 27.9 and Conradson carbon number of 0.28% was used as the feed. Portions of the oil contained levels of nickel from about 1 to about 6000 ppm. Both untreated and phosphorus-impregnated catalysts were used. Phosphorus impregnation was at a level of 1.0% P by volatile-free weight.

After treatment in the simulated laboratory-scale cracking unit and calcination in air at 1000° F. for 2 hours to burn off coke, catalysts were analyzed chemically for P and Ni and evaluated in a standard MAT (microactivity test) unit for levels of hydrogen and coke make and cracking activity. Conditions in the MAT unit were cat/oil ratio=5.0 and space velocity=7.5 $hr^{-1}$. Conversion ranged from about 60% to about 70%. As shown in the accompanying drawing, the 1.0% P impregnated catalyst showed a reduction in both hydrogen make and coke factor of about 40% at the higher levels of nickel loading, e.g. above about 0.3% by volatile-free weight. Smaller reductions were observed at lower levels of nickel loading.

EXAMPLE 6

It its recognized in the art that contaminant metals lose a portion of their ability to promote generation of hydrogen gas and coke subsequent to their deposition onto fluid cracking catalysts in commercial cracking units. To simulate equilibrium catalyst containing "aged" metals, defined as those which have undergone repeated cycles of cracking and regeneration and have lost some of their aforementioned ability to promote hydrogen and coke formation, a laboratory-scale aging test was employed. For this test an automated, fixed fluidized-bed unit was used. This unit was capable of repetitive cycling through cracking conditions (reducing atmosphere), stripping (inert atmosphere), and higher temperature regeneration (oxidizing atmosphere). In actual operation in a commercial FCC unit, the catalyst may be recycled hundreds of times before being discarded. After 10–14 cycles in the aging unit catalysts of the present invention showed no further changes in performance or properties, so that 10–14 cycles was considered sufficient for yielding a catalyst suitable for MAT testing, which was approximately equivalent to an equilibrium catalyst.

Prior to the cycling tests in the aging unit the catalyst samples were treated according to illustrative Example 1, wherein contaminant metals were first impregnated onto the catalyst in various quantities and then calcined to burn off the organics. After drying the catalyst was subjected to passivation treatment. Samples received treatment with a commercially available passivator, an organic solution of an antimony tris (0,0 hydrocarbylphosphorodithioate) sold under the trademark Vanlube 622 or a compound of boron. A portion of the samples received an additional treatment with organic solution of tricresyl phosphate to show the advantages of adding additional phosphorus to the catalyst for enhanced and improved passivation capability. After drying, the samples were then used directly in the fixed fluidized bed aging unit cycling procedure under the following typical conditions:

Cat/oil=5
WHSV=4.8 $hr.^{-1}$
2.5 minutes cracking at 950° F.
5.5 minutes $N_2$ purge
35 minutes air regeneration at 1250°
10 minutes cooling to 950° F.
5 minutes $N_2$ purge After 12 cycles in the aging unit samples of catalyst were withdrawn for evaluation on the MAT unit.

In the MAT unit the hydrogen yield and coke factor were obtained for nickel-poisoned catalyst, vanadium-poisoned catalyst untreated and treated with Vanlube 622 or boron with and without additional phosphorus. Results are shown below in Tables II and III. Conditions in the MAT unit were WHSV of 15 and a cat/oil of 5.0. Conversion was 76–80%.

TABLE II

PASSIVATION OF NICKEL BY ADDITIONAL PHOSPHORUS IN PRESENCE OF METALLIC COMPOUND PASSIVATOR

| Catalyst and Additive | Nickel Level, ppm | $H_2$ Yield, Wt. % of Feed | Coke Factor |
|---|---|---|---|
| Untreated | 1705 | 0.60 | 1.55 |
| Vanlube 622 Sb/Ni = 0.6 P/Ni = 2.0 | 1705 | 0.30 | 1.14 |
| Vanlube 622 & Phosphorus Sb/Ni = 0.6 P/Ni = 8.5 | 1705 | 0.17 | 0.96 |

TABLE III

PASSIVATION OF VANADIUM BY ADDITIONAL PHOSPHORUS IN PRESENCE OF METALLIC COMPOUND PASSIVATOR

| Catalyst and Additive | Vanadium Level ppm | $H_2$ Yield, Wt. % of Feed | Coke Factor |
|---|---|---|---|
| Untreated | 3555 | 0.56 | 1.56 |
| Vanlube 622 Sb/V = 0.55 P/V = 2.2 | 3555 | 0.31 | 1.27 |
| Vanlube 622 & Phosphorus Sb/V = 0.47 P/V = 6.5 | 3555 | 0.24 | 1.05 |
| Boron & Phosphorus B/V = 3.5 P/V = 4.4 | 3555 | 0.22 | 1.13 |

As can be seen from both of the above tables, addition of phosphorus results in further, significant reductions of both $H_2$ yield and coke make. Table III also shows phosphorus in combination with boron at the mole ratios indicated is effective at reducing hydrogen and coke.

In another test the passivation effects of boron and phosphorus were investigated using a different rare-earth exchanged zeolitic fluid cracking catalyst (catalyst "B") than before. The results of these tests are shown in Table IV hereinbelow. Test conditions of Table IV were identical to those of Tables II and III.

TABLE IV

THE PASSIVATION EFFECTS OF BORON AND PHOSPHORUS

| Catalyst and Additive | Vanadium Level, ppm | $H_2$ Yield, Wt. % of Feed | Coke Factor |
|---|---|---|---|
| Untreated "B" | 3630 | 0.54 | 1.52 |
| Boron Treated "B" B/V = 5.5 | 3630 | 0.26 | 1.30 |
| Phosphorus Treated "B" P/V = 4.5 | 3630 | 0.36 | 1.14 |

As is shown in the table, catalyst "B", even when contaminated with higher levels of vanadium, produces inherently less hydrogen and coke than the catalyst of Table II. Both boron and phosphorus are shown to be effective passivating agents for vanadium. The boron and phosphorus combination shown in Table III indicates that the beneficial effect of passivation is best for the combination over either boron or phosphorus used alone. The boron alone reduces hydrogen yield better than the phosphorus alone, as shown in Table IV above, but phosphorus alone reduces coke factor better than boron alone at the same level of addition. With the combination of phosphorus and boron at about the same overall level, the best effects of each are retained. It is presumed likely that similar results would be achieved by adding phosphorus to passivators such as antimony, tin, bismuth, thallium and the like containing compounds.

We claim:

1. In a process for cracking hydrocarbon feedstock contaminated with a metal poison comprising at least one of nickel, vanadium, iron and copper, by contacting the feedstock with a zeolite fluid cracking catalyst under cracking conditions, the improvement which comprises contacting said catalyst with an added phosphorus compound in amount sufficient to effect passivation of said metal poison, said added phosphorus compound being selected from the group consisting of tricresyl phosphate, an ammonium hydrogen phosphate, and mixtures thereof.

2. The process of claim 1 where said phosphorus compound is added to the hydrocarbon feedstock in oil-soluble form to impregnate said catalyst.

3. The process of claim 1 wherein said catalyst is impregnated with said phosphorus compound prior to being introduced into said process.

4. The process of claim 1 wherein said phosphorus compound is tricresyl phosphate.

5. The process of claim 1 wherein said phosphorus compound is an ammonium hydrogen phosphate.

6. The process of claim 3 wherein said phosphorus compound is present on said catalyst in amount in the range of about 0.01% to about 5% P by volatile-free weight.

7. A process for restoring the selectivity of a zeolitic fluid cracking catalyst which has become contaminated with a metal poison comprising at least one of nickel, vanadium, iron and copper, which process comprises contacting said catalyst with a phosphorus compound in amount sufficient to effect passivation of said metal poison, said phosphorus compound being selected from the group consisting of tricresyl phosphate, an ammonium hydrogen phosphate, and mixtures thereof.

8. The process of claim 7 wherein said phosphorus compound is added to the hydrocarbon feedstock which is then charged to a catalytic cracking zone with said catalyst.

9. The process of claim 7 wherein said catalyst is first contacted with said phosphorus compound and then calcined at elevated temperature in the presence of free oxygen to regenerate said catalyst.

10. The process of claim 9 wherein said temperature is in the range 800° F.–1300° F.

11. In a process for cracking hydrocarbon feedstock contaminated with a metal poison comprising at least one of nickel, vanadium, iron and copper, by contacting the feedstock with a zeolite fluid cracking catalyst, the improvement which comprises adding said cracking catalyst and a separate, inert diluent carrier material to a cracking zone in said process, said inert carrier material being impregnated with a phosphorus compound in amount sufficient to effect passivation of said metal poison, said phosphorus compound being selected from the group consisting of tricresyl phosphate, an ammonium hydrogen phosphate, and mixtures thereof.

12. The process of claim 11 wherein said inert carrier material comprises calcined metakaolin clay microspheres having diameter in the range 20 to 150 microns.

13. In a process for cracking hydrocarbon feedstock contaminated with a metal poison comprising at least one of nickel, vanadium, iron and copper, by contacting the feedstock with a zeolitic fluid cracking catalyst and wherein a passivating agent selected from the group consisting of one or more of antimony, boron, tin, bismuth, thallium, manganese, and compounds thereof is added to said catalyst, the improvement which comprises adding to said catalyst a phosphorus compound selected from the group consisting of tricresyl phosphate, an ammonium hydrogen phosphate, and mixtures thereof.

14. The process of claim 13 wherein said passivating agent is boron, or a compound thereof.

15. The process of claim 1 wherein a passivating agent selected from the group consisting of one or more of antimony, boron, tin, bismuth, thallium, manganese and compounds thereof is added to said catalyst.

16. The process of claim 15 wherein said passivating agent is boron, or a compound thereof.

* * * * *